United States Patent [19]

Chaddock

[11] 4,317,254

[45] Mar. 2, 1982

[54] DOOR CLOSER

[75] Inventor: Dennis H. Chaddock, Loughborough, England

[73] Assignee: Perkins & Powell Limited, Birmingham, England

[21] Appl. No.: 132,319

[22] Filed: Mar. 20, 1980

[30] Foreign Application Priority Data

Mar. 20, 1979 [GB] United Kingdom ..... 79097/79

[51] Int. Cl.[3] ..... E05F 3/04; E05F 3/12

[52] U.S. Cl. ..... 16/61

[58] Field of Search ..... 16/51, 52, 58, 61, 63, 16/67, 71, 78

[56] References Cited

U.S. PATENT DOCUMENTS

| | | | |
|---|---|---|---|
| 370,468 | 9/1887 | Griffing et al. | 16/78 X |
| 1,114,184 | 10/1914 | Richmond | 16/52 |
| 1,239,510 | 9/1917 | Nordquist | 16/51 |
| 1,711,826 | 5/1929 | Bernhard | 16/61 |
| 2,841,813 | 7/1958 | Falk | 16/66 |
| 3,149,366 | 9/1964 | Martin | 16/51 |
| 3,834,282 | 9/1974 | Kongelbeck | 16/51 X |
| 3,887,961 | 6/1975 | Saajos | 16/51 X |

FOREIGN PATENT DOCUMENTS

| | | | |
|---|---|---|---|
| 635971 | 4/1950 | United Kingdom | 16/61 |
| 1120102 | 7/1968 | United Kingdom | 16/52 |
| 1161859 | 8/1969 | United Kingdom | 16/58 |
| 1239915 | 7/1971 | United Kingdom | 16/51 |

*Primary Examiner*—Wm. Carter Reynolds

*Attorney, Agent, or Firm*—Barlow & Barlow

[57] ABSTRACT

A door closer includes a tension member comprising spaced shafts acted by springs and connected to articulated chains which are coupled to an anchor plate secured to the door frame. Movement of the shafts is under the control of a uni-directionally operative fluid-filled damper having a piston carried by a piston rod which is connected to a cross head slidably mounted on the shafts and held against abutment washers by the springs. The damper serves to regulate the rate of movement of a door in the direction of closure without restricting significantly the rate of movement in the direction of opening. A fluid by-pass is provided in the damper by a rebate formed in the cylinder so that as the piston approaches the end of the cylinder over the final part of the closure movement the restraint imposed by the damper is relieved. The point in the closure movement at which the fluid by-pass becomes operative can be varied while the closer is installed so as to provide compensation for variations in the installation of the closer and variations of the gap between the door and its frame. In one embodiment this is achieved by securing the chains to an adjustment plate which is movable towards and away from the anchor plate. In another embodiment the piston rod is adjustable secured to the cross head, which in this case is in the form of a stirrup with a cross member on which the piston rod is carried presented towards and accessible from the outer end of the housing so as to enable the piston rod to be adjusted.

15 Claims, 6 Drawing Figures

DOOR CLOSER

BACKGROUND OF THE INVENTION

1. Field of the Invention

This invention concerns a door closer of the kind (herein called "of the kind specified") including a tension member acted on by spring means under the control of a uni-directionally operative fluid damping means which serves to regulate the rate of movement of a door, with which the closer is installed, in the direction of closure without restricting significantly the rate of movement in the direction of opening.

2. Description of the Prior Art

Door closers are known in a wide variety of forms specially adapted for various purposes. One such type (for example as shown in U.S. Pat. No. 4,115,897) includes a body for fitting to the face of a door and an articulated arm which is secured to the door frame. Whilst this type can readily be made adjustable because the housing is at all times accessible, it is not entirely acceptable for use in domestic premises for aesthetic reasons.

Another type (for example as shown in British Pat. specification No. 978,967) which includes a rotatable spindle through which movement is transmitted to the door can be concealed in the door frame, but is not entirely suitable for domestic use because of difficulties in installation, and moreover is generally not suitable for installation to an existing door.

For domestic, and many other uses, door closers of the kind specified are generally preferred, that is to say those which operate essentially by linear movement of a tension member, and more especially the type including a housing which in use is mounted within the thickness of the door itself (for example as described in French patent specification No. 1,587,528) and it is this type of door closer to which the invention relates.

It is recognised that where the rate of closure of a door is restricted by a damper of some kind, it is desirable to be able to relieve the operation of the damper, or render it ineffective, just before the door reaches its closed position so that the resistance afforded by any latch or catch on the door will be overcome to ensure that the door closes fully and is latched. This may be achieved, in the case of an hydraulic damper, by means of a suitable fluid by-pass. Because such closers act at the hinged edge of the door a very small movement of the closer corresponds to a large movement of the free edge of the door, and typically a factor of thirty times or more may be involved.

Thus, if the fluid by-pass is to operate correctly, the closer must be installed very accurately. In practice this is difficult to achieve and requires much skill. Firstly, the precise depth to which the housing is inserted in the door from the hinged edge thereof is difficult to control. Secondly, the width of the gap between the hinged edge of the door and the door frame when the door is closed may vary appreciably in different installations.

For these reasons, the amount of unrestricted travel at the free edge of the door while the damper is rendered inoperative may vary between zero and its design maximum purely according to the manner in which the closer is installed.

SUMMARY OF THE INVENTION

Accordingly, it is an object of the invention to provide a door closer in which such difficulties are avoided.

With this object in view, we provide a door closer of the kind specified (in which the rate of closure of the door is restrained by a fluid damping means) wherein a fluid by-pass in the damping means is operative over the final part of the closure movement to remove the restraint imposed by the damping means, and the closer when installed is adjustable to vary the point in the closure movement at which the fluid by-pass becomes operative.

The invention also resides in a door closer comprising:

(a) a housing for fitting into a door and an anchor plate for fixing to a door frame adjacent to said door;

(b) a tension member extending longitudinally within the housing and having an outer end portion thereof in the form of an articulated chain which is coupled to said anchor plate;

(c) main spring means in said housing and acting on said tension member to urge the latter inwardly of the housing and draw the housing and the anchor plate together so as to close the door to which the closer is fitted;

(d) damping means comprising a piston coupled to said tension member and slidable in a fluid-filled chamber which is divided into two compartments with valve means permitting relatively free movement of the fluid from one compartment to the other when the piston is moved in response to movement of the tension member outwardly of the housing, that is in the door opening direction, but affording sufficient resistance to movement of the fluid in the opposite direction to control the rate of movement of the tension member inwardly of the housing, that is in the door closing direction under the force of said spring means;

(e) a lost motion means whereby the piston is coupled to said tension member for enabling the tension member to be moved inwardly of the housing in the door closing direction in response to an external force at a rate faster than that determined by said main spring means under the control of the damping means; and (f) additional spring means for maintaining tension in said articulated chain independently of said main spring.

BRIEF DESCRIPTION OF THE DRAWINGS

The invention will now be described by way of example with reference to the accompanying drawings wherein.

DESCRIPTION OF THE PREFERRED EMBODIMENTS

Referring now to the accompanying drawings, a preferred embodiment of door closer in accordance with the invention, as shown in FIGS. 1 to 5, includes a housing 10 having three internal parallel bores comprising a central bore 11 and two outer bores 12. At one end of the housing, namely the in situ inner end 10*a*, slots 13 are formed internally of the housing between the central bore 11 and the outer bores 12 for the purpose hereinafter explained.

Figure 2:
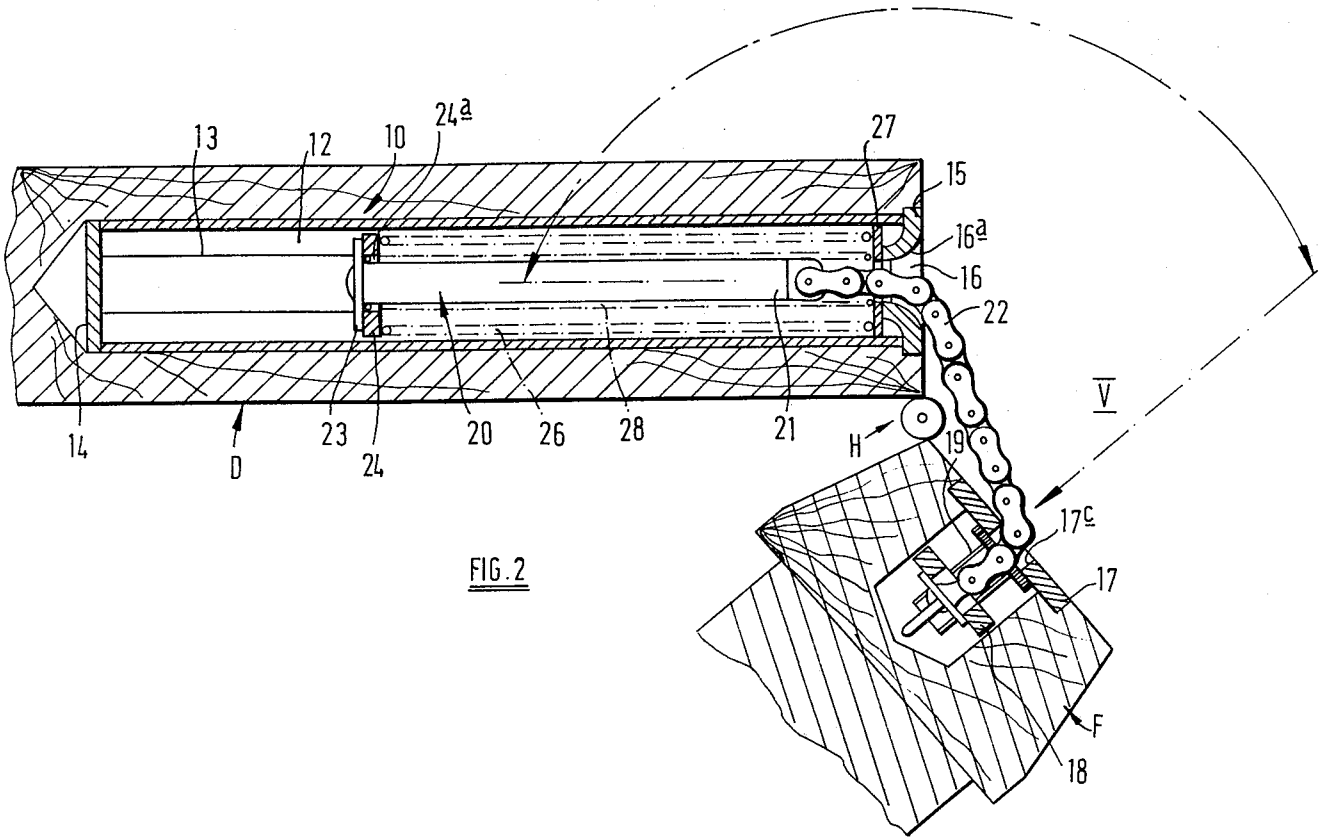
FIG. 2 shows a horizontal section on the line II—II of FIG. 1, but with the closer installed and in its "extended" or "door open" condition.
Figure 3:
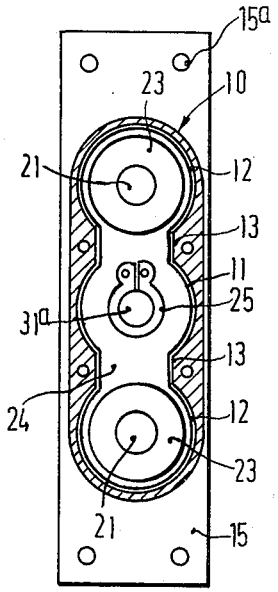
FIGS. 3 and 4 respectively show vertical cross-sections on the lines III—III and IV—IV of FIG. 1.
Figure 4:
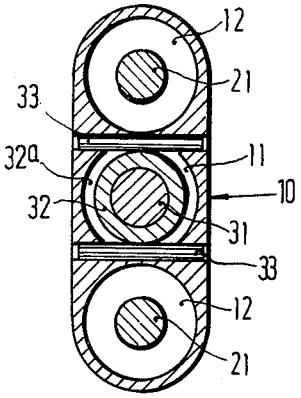
Figure 5:
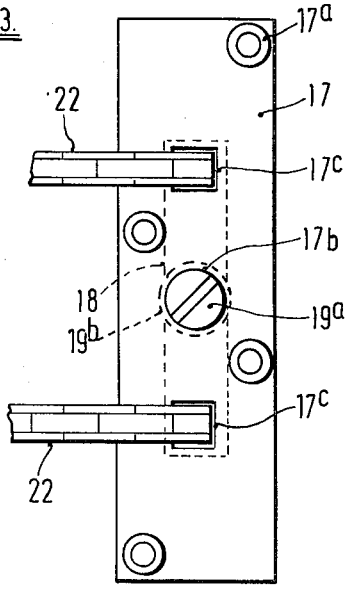
FIG. 5 shows a view in the direction of arrow V in FIG. 2.

The housing is completed by an inner end closure plate 14 and at the opposite, outer end 10*b*, an outer end mounting plate 15. The latter includes a pair of apertures 16 formed by pressing out curved tongs 16*a*, as best seen in FIG. 2, from the plate so as to define rectangular-shaped openings in register with each of the outer bores 12 and affording outwardly widening curved guides. In use, the housing 10 is mounted in a recess formed internally within a door D (FIG. 2), and it is secured in position by means of screws (not shown) passing through apertures 15*a* in the mounting plate at positions laterally off-set from the housing.

The door closer also includes an anchor plate 17 which is similarly mounted on the door frame F (FIG. 2). In the embodiment illustrated in FIGS. 1 to 5, the anchor plate 17 is connected only to a tension member 20 as hereinafter described, but in an alternative embodiment the anchor plate 17 may be hingedly connected with the mounting plate 15 so as to take the place of one of the conventional hinges shown at H in FIG. 2.

Figure 1:
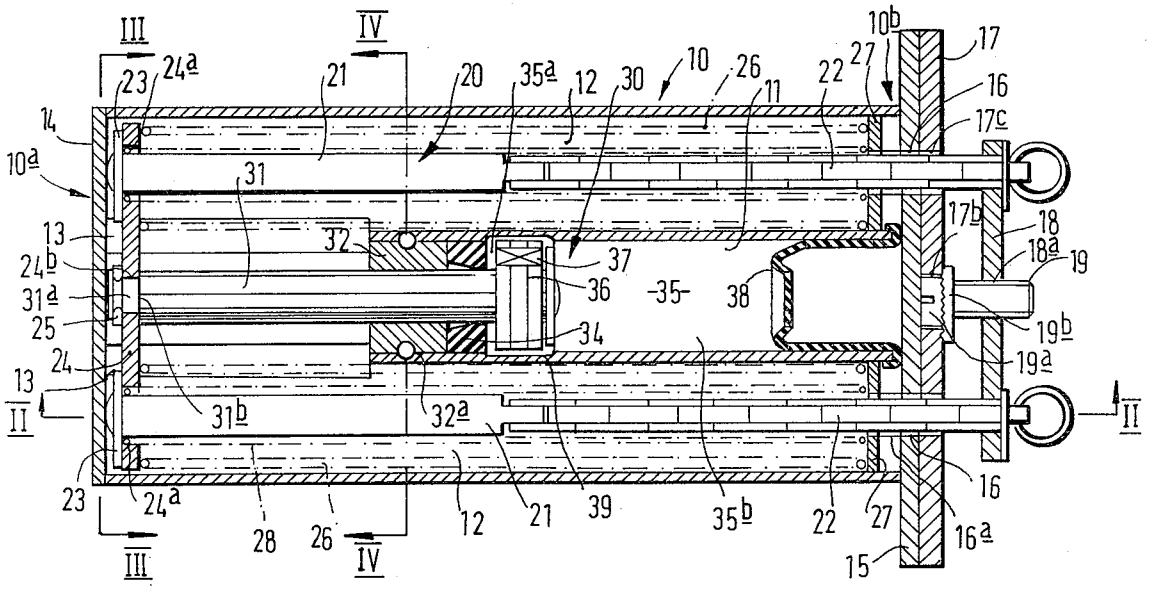
FIG. 1 shows a longitudinal section through a first embodiment of door closer in accordance with the invention in its "contracted" or "door closed" condition.

The anchor plate 17 is formed with conventional screw holes 17*a* for mounting to the door frame by means of screws and carries an adjustment plate 18 which is received in a recess formed in the door frame for this purpose. The plate 18 is supported by a screw 19 extending through a threaded hole 18*a* formed centrally in the plate 18. A central hole 17*b* is formed in the anchor plate to receive the head 19*a* of the screw 19, and a serrated washer 19*b* fixed to the underside of the head 19*a* bears on the rear face of the anchor plate 17 as illustrated in FIG. 1. The tension member 20 is connected to the anchor plate 17 through the intermediary of the adjustment plate 18, and by rotation of the screw 19 the spacing between the two plates 17 and 18 may be varied after the closer is installed.

The tension member 20 in the illustrated embodiment includes a pair of longitudinal parallel shafts 21 disposed co-axially within the respective outer bores 12, and respective articulated chains 22 extending from the outer end of the shafts and projecting out of the housing 10 through the apertures 16 in the mounting plate 15. The chains 22 extend through apertures 17*c* in the anchor plate 17 and are attached to the adjustment plate 18. At the inner ends, the shafts 21 carry abutments 23 in the form of washers which engage the inner face of a cross head 24 which extends transversely through the slots 13 and between the two shafts. The cross head 24 is formed with apertures 24*a* through which the shafts extend, as seen most clearly in FIG. 1.

The outer bores 12 contain the main spring means comprising coiled compression springs 26 which bear at their inner ends on the outer face of the cross head 24, and at their outer ends on apertured discs 27 which bear on the ends of the inturned tongs 16*a*. Thus, the springs 26 urge the cross head 24 inwardly of the housing against abutment washers 23 and thereby draw the shafts 21 into the housing so as to pull the anchor plate 17 and housing 10 towards one another. In this way, the door D in which the closer is mounted will normally be held in a closed position. When the door is opened, the mounting plate 15 is drawn away from the anchor plate 17 in an arcuate path as indicated in FIG. 2, so that the shafts 21 are pulled outwardly and the springs 26 are compressed. Thus, when the door is released, the springs 26 tend to restore the door to its position of closure.

In order to prevent the door closing too rapidly damping means comprising, a uni-directionally operative damper 30 is provided within the central bore 11 of the housing 10. This damper includes a piston rod 31 which is disposed parallel to the shafts 21 and includes a reduced diameter end portion 31*a* which extends through a central aperture 24*b* in the cross head 24 and carries a spring clip 25 whereby the cross head is held against the shoulder 31*b* at the junction of the main part of the piston rod 31 and its reduced diameter end portion 31*a*. The cross head 24 is thus fixedly secured to the piston rod 31, whilst it is slidably assembled with the shafts 21 and normally maintained in engagement with the abutment washers 23 by means of the springs 26.

The piston rod 31 is guided in a bushing 32 held in position within the central bore by means of a pair of pins 33 extending through transverse bores in the body 10 and entering in a peripheral groove 32*a* formed in the bushing. The piston rod also extends through a gland 34 which sealingly engages both the piston rod 31 and the internal surface of the central bore 11. The piston rod carries a piston 36 which is slidably engaged within the bore, and a flexible diaphragm 38 is secured in position at the outer end of the bore 11 by means of the mounting plate 15.

The central bore 11 between the gland 34 and the diaphragm 38 defines a chamber 35 which is filled with a suitable fluid, and the piston 36 is formed or provided with a valve (indicated diagrammatically at 37) of known construction which affords substantial resistance to the passage of fluid past the piston in one direction, but not in the other. In the embodiment illustrated in FIG. 1, the valve 37 is arranged to afford resistance to the transfer of fluid from an outer compartment 35*a* of the chamber defined between the gland 34 and the piston 36 to an inner compartment 35*b* of the chamber defined between the piston 36 and diaphragm 38. It will be understood that the outer compartment 35*a* of the chamber is disposed towards the inner end of the housing and vice-versa and that the valve 37 affords resistance to inward movement of the piston 36 relative to the housing 10 (i.e. from right to left as shown in FIG. 1, or outwardly relative to the chamber 35) as the piston rod 31 is moved inwardly of the housing by the cross head 24 under the force applied by the springs 26. In this way, the anchor plate and the mounting plate 15 are drawn together by the tension member 20 comprising the shafts 21, chains 22 and cross head 24, at a rate controlled by the valve 37 in the damper 30, and the rate at which the door is closed is likewise controlled.

However, on occasions it may be desirable for the door to be closed manually, or in response to other external force, at a faster rate than provided by the springs 26 under the control of the damper 30. Since the cross head 24 is slidably associated with the shafts 21, it will be seen that if the door is forcibly closed, the shafts 21 can move inwardly of the housing 10 faster than the cross head 24, the abutment washers 23 then being moved away from the cross head 24. The sliding connection thus established between the shafts 21 and cross head 24 serves as a lost motion means to enable the door to override the tension member 20, and in order to prevent the articulated chains 22 from buckling under these conditions, and perhaps jamming in the apertures 16 additional spring means comprising, auxiliary springs 28 are provided within each outer bore 12. These auxiliary springs act at their outer ends against the discs 27, but at their inner ends they extend through the apertures 24*a* in the cross head and bear directly against the abutment washers 23. Thus, the auxiliary springs 28 ensure that the articulated chains 22 are always maintained in tension, and enable the shafts 21 to move inwardly of the housing 10 faster than the cross head 24 in response to an external force applied to the door D.

The closer in accordance with the invention has provision for enabling the restraining effect of the damper 30 to become inoperative over the final part of the closure movement of the door so as to overcome any resistance which may be encountered due to the provision of a latch or the like on the door. For this purpose, the central bore 11 of the housing, which in part defines the chamber 35 containing the fluid of the damper 30, is formed with an annular rebate 39 so that the bore 11 is of locally increased internal diameter immediately adjacent to the gland 34. Thus, when the piston 36 is nearly at the end of the chamber adjacent to the gland 34, the rebate serves as fluid by-pass means whereby fluid may flow freely around the outside of the piston so that the full force of the springs 26 is then exerted through the tension member 20 to close the door against any resistance afforded by a latch or the like.

It is desirable that the extent of such unrestrained movement of the piston should be adjustable for two reasons. Firstly, the resistance afforded by differing types of latch varies considerably and in order to avoid the door slamming noisily where only light resistance is encountered it is desirable for the amount of unrestricted movement to be reduced as compared with that necessary where the resistance afforded by a stiff latch has to be overcome. Indeed, it may be desirable to be able to eliminate the unrestrained movement entirely, for example if the closer is to be installed on a door which is not provided with any latch at all. It is desirable for this to be possible whilst the closer is installed because of the difficulty of repeatedly removing and replacing the closer during the installation procedure whilst such adjustment is carried out and tested.

However, the second reason for making provision for such adjustment is even more important. Since the closer acts at the hinged edge of the door, a very small movement of the tension member 20 corresponds to a large movement at the free edge of the door. Accordingly, in the absence of means for adjusting the range of unrestricted movement of the piston, the effectiveness of the fluid by-pass in producing a suitable range of unrestrained movement of the piston may be completely negatived by a relatively small error in the position of the housing as installed in the door. Thus, if the mounting plate 17 is recessed too deeply in the door (perhaps by as little as only two millimeters) when the door is fully closed the mounting plate 15 will be spaced from the anchor plate 17 and the piston will be held at a position to the right of that shown in FIG. 1, possibly without the fluid by-pass becoming operative at all.

Since the spacing between the inner edge face of a door and the corresponding face of a door frame may in practice vary from zero up to about at least five millimeters, it will be appreciated that, even if the mounting plate 15 is very carefully installed so that its outer face is flush with the edge face of the door, a similar, and possibly even greater, difficulty can arise due simply to this factor. So far as we are aware no closer of the type to which this invention relates has been entirely satisfactory from this point of view, because of the lack of provision for adjustment of the range of unrestricted movement of the door during its final closure after the door closer has been installed.

By providing adjustment means in the form of the adjustment plate 18 which is movable relative to the anchor plate 17 as previously described, the position of the piston 36 in the central bore relative to the rebate 39 when the door is in its closed position may be varied after the closer is installed. In this way, differences due to the width of the gap between the inner edge face of the door and the corresponding edge of the frame can be eliminated and an appropriate portion of the unrestricted range of travel of the piston may be utilised according to the resistance afforded by the particular latch, if any, which is provided on the door. Thus, where no increased rate of final closure is required, the screw 19 can be adjusted so that the door is fully closed before the piston 16 is fully in register with the rebate 39 of the bore 11. Alternatively, the plate 18 can be adjusted so that the "door closed" position of the piston corresponds to any selected position within the axial length of the rebate 39 corresponding to the amount of unrestricted travel required. These adjustments can be made despite variations, as between different doors, of the gap at the inner edge of the door when it is closed and despite possible inaccuracies in the depth to which the mounting plate is recessed into the edge face of the door. For this purpose, the axial length of the rebate 39 should be equal to the axial length of the piston plus a length corresponding to the maximum amount of unrestricted movement which it is desired to provide at the free edge of the door, with the further addition of a length corresponding to the maximum width of gap at the inner edge of the door likely to be encountered in practice.

In the alternative embodiment shown in FIG. 6, parts equivalent to those described in relation to the embodiment shown in FIGS. 1 to 5 are identified by the same reference numerals and the preceding description is fully applicable to those parts except as hereinafter explained. In this embodiment, the chains 22 are secured directly to the anchor plate 17 and the adjustment plate 18 and screw 19 are omitted. This simplifies the installation of the anchor plate since in this case it is not necessary to form a recess in the door frame to accommodate the adjustment plate spaced rearwardly from the anchor plate. The desired adjustment of the piston 36 relative to the rebate 39 when the door is in its closed position is achieved in this embodiment by making the piston 36 adjustable relative to the tension member 20. For this purpose, the structure of the damper 130 is reversed as compared with the damper 30 so that the piston rod 131 extends outwardly from the piston relative to the housing 10 instead of inwardly as in the previous embodiment, and the straight cross head 24 is replaced by a modified cross head 124 in the form of a stirrup including lugs 141 which engage the abutment washers 23, parallel straps 142 which extend alongside the damper 130 externally of the central bore 11, and a cross member 143 which extends transversley between the shafts 21 at a position spaced from the inner ends of the shafts and through slots 113 formed at the outer end of the bore 11 instead of the slots 13 of the previously described embodiment.

Means for adjusting the piston rod 131 relative to the cross member 143 is provided by an externally threaded end portion 131*a* on the rod received in a threaded hole 143*a* formed in the cross member 143. A slot 131*b* in the end of the piston 131 is accessible through a central aperture 15*b* which is formed in the mounting plate 15 in this embodiment. To prevent inadvertent uncoupling of the piston rod 131 from the cross member 143, a washer 144 is preferably fixed to the end of the piston rod to engage against the cross member 143 and limit movement of the piston rod inwardly of the housing.

Figure 6:
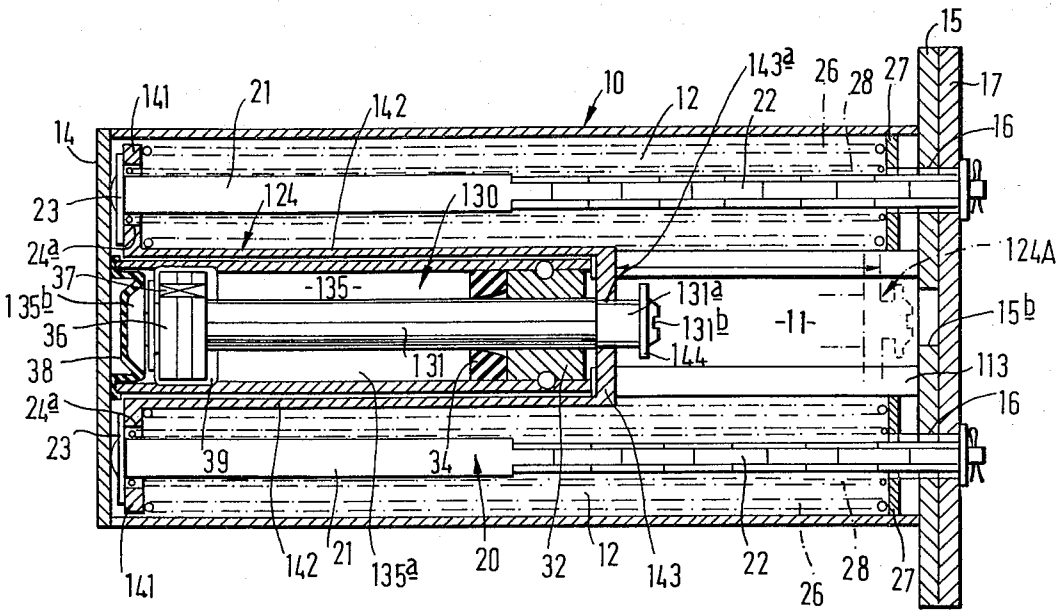
FIG. 6 illustrates an alternative embodiment in a view similar to that of FIG. 1.

When the door is opened, the cross head 124 is moved to the right, as shown in FIG. 6, up to the position indicated at 124A, whereupon the piston rod 131 can easily be adjusted by means of a screwdriver inserted through the aperture 15*b*.

As can be seen, the piston 36 is disposed at the inner end of the chamber 135 relative to the housing 10 when the door is closed, and accordingly the rebate 39 is formed at the inner end of the chamber, although the gland 34 and bushing 32 are at the outer end because the piston rod 131 extends from the piston 36 in the opposite direction as compared with the piston rod 31 of the first embodiment. It will be understood that the valve 37 is designed in known manner to allow unrestricted flow of fluid from the compartment 135*a* between the piston 36 and gland 34 (that is to say the outer compartment relative to the housing 10 and relative to the piston rod) into the compartment 135*b* between the piston 36 and the diaphragm 38 (that is to say the inner compartment relative to the housing and to the piston rod) as the piston is moved from left to right in FIG. 6 in response to opening movement of the door. Conversely, the valve 37 imposes a resistance to flow of fluid in the opposite direction from the compartment 135*b* to the compartment 135*a* as the piston is moved from right to left by the springs 26 as the door is closed, and thus the rate of closure of the door is controlled until the piston 36 comes fully into register with the rebate 39, as in the previously described embodiment.

Whilst the damper in these embodiments is shown as integrated into the housing 10, it will be understood that it would alternatively be possible to utilise a self-contained damper unit having its own external cylinder, which would be placed within the central bore 11 of the housing 10. Because whilst the damper as illustrated utilises a wide annular rebate 39 to afford the fluid by-pass, a similar effect may be achieved by one or more axially extending slots. In order to effect a smooth transition, the cross-sectional area of the fluid passageway afforded by the fluid by-pass may be arranged so as to increase gradually as it is uncovered by the piston, i.e. the width or depth of the rebate 39 may be non-uniform.

I claim:

1. A door closer comprising:

(a) a housing for fitting into a door and an anchor plate for fixing to a door frame adjacent to said door;

(b) a tension member extending longitudinally within the housing and having an outer end portion thereof in the form of an articulated chain which is coupled to said anchor plate;

(c) main spring means in said housing and acting on said tension member to urge the latter inwardly of the housing and draw the housing and the anchor plate together so as to close the door to which the closer is fitted;

(d) damping means comprising a piston coupled to said tension member and slidable in a fluid-filled chamber which is divided into two compartments with valve means permitting relatively free movement of the fluid from one compartment to the other when the piston is moved in response to movement of the tension member outwardly of the housing, that is in the door opening direction, but affording sufficient resistance to movement of the fluid in the opposite direction to control the rate of movement of the tension member inwardly of the housing, that is in the door closing direction, under the force of said spring means;

(e) a lost motion means whereby the piston is coupled to said tension member for enabling the tension member to be moved inwardly of the housing in the door closing direction in response to an external force at a rate faster than that determined by said main spring means under the control of the damping means; and (f) additional spring means for maintaining tension in said articulated chain independently of said main spring means.

2. A door closer according to claim 1 wherein said tension member comprises two spaced parallel shafts interconnected at their inner ends by a cross head and said damping means is disposed between the two shafts, the piston thereof being carried by a piston rod which extends parallel to the shafts and is connected to the cross head.

3. A door closer according to claim 2 wherein the piston rod is fixedly secured to the cross head whilst the cross head itself is slidably coupled to the shafts so as to afford said lost motion means.

4. A door closer according to claim 2 wherein the cross head is disposed at the inner ends of the shafts and the fluid filled chamber is disposed at the outer end of the housing so that the piston moves inwardly of said chamber as the tension member is moved from an inner "door closed" position towards an outer "door open" position relative to the housing in response to door opening movement.

5. A door closer according to claim 2 wherein the cross head is in the form of a stirrup including a cross member which extends transversely between the shafts at a position spaced from the inner ends of the shafts, and the fluid filled chamber is disposed at the inner end of the housing so that the piston moves outwardly of said chamber as the tension member is moved from an inner "door closed" position towards an outer "door open" position relative to the housing in response to door opening movement.

6. A door closer according to claim 3 wherein said main spring means acts directly on the cross head and the force of said main spring means is transmitted to the shafts by engagement of said cross head with abutments provided at the inner ends of said shafts.

7. A door closer according to claim 6 wherein the additional spring means engage the abutments carried by the shafts of the tension member.

8. A door closer according to claim 1 wherein fluid by-pass means are provided for relieving said resistance afforded by said damping means over a final portion of the range of movement of the tension member into its "door closed" position in order to allow the force exerted by said main spring means to accelerate the door to overcome any additional resistance afforded by a latch or catch on the door, and adjustment means are provided which are operable when the door closer is installed to adjust the position of both the tension member and the piston relative to the anchor plate, thereby effecting adjustment of said fluid by-pass means.

9. A door closer according to claim 8 wherein said adjustment means comprise an adjustment plate adjustably mounted on said anchor plate in such a manner that the spacing between the two plates can be varied, the articulated chain being secured to said adjustment plate.

10. A door closer according to claim 1 wherein fluid by-pass means are provided for relieving said resistance afforded by said damping means over a final portion of the range of movement of the tension member into its "door closed" position in order to allow the force exerted by said main spring means to accelerate the door to overcome any additional resistance afforded by a latch or catch on the door, and adjustment means are provided which are operable when the door closer is installed to adjust the position of the piston relative to both the tension member and the anchor plate, thereby effecting adjustment of said fluid by-pass means, the adjustment means being disposed within the housing at a position accessible from the outer end thereof.

11. A door closer comprising:

(a) a housing for fitting into a door and an anchor plate for fixing to a door frame adjacent to said door;

(b) a tension member extending longitudinally within the housing and coupled at its outer end to said anchor plate;

(c) spring means in said housing and acting on said tension member to urge the latter from an outer or "door open" position in a direction inwardly of the housing towards an inner or "door closed" position and thereby to draw the housing and the anchor plate together so as to close the door to which the closer is fitted;

(d) uni-directionally operative fluid damping means including a piston slidable in a fluid-filled chamber between corresponding "door open" and "door closed" positions and coupled to said tension member for providing resistance to movement of the tension member inwardly of the housing so as to control the rate of movement of the tension member inwardly of the housing under the force of said spring means;

(e) fluid by-pass means for relieving said resistance over a final portion of the range of movement of the tension member into its "door closed" position in order to allow the force exerted by said spring means to accelerate the door to overcome any additional resistance afforded by a latch or catch on the door; and (f) adjustment means operable when the door closer is installed, comprising an adjustment plate connected to said tension member and adjustably mounted on said anchor plate in such a manner that the spacing between the two plates can be varied to adjust the position of the tension member and the piston relative to the housing, thereby to adjust the relative position of the piston in said chamber so as to enable the operation of said fluid by-pass means to be adjusted.

12. A door closer comprising:

(a) a housing for fitting into a door and an anchor plate for fixing to a door frame adjacent to said door;

(b) a tension member extending longitudinally within the housing, coupled at its outer end to said anchor plate, and comprising two spaced parallel shafts interconnected at their inner ends by a cross head in the form of a stirrup including a cross member which extends transversely between the shafts at a position spaced from the inner ends of the shafts;

(c) a spring means in said housing and acting on said tension member to urge the latter from an outer or "door open" position in a direction inwardly of the housing towards an inner or "door closed" position and thereby to draw the housing and the anchor plate together so as to close the door to which the closer is fitted;

(d) uni-directionally operative fluid damping means disposed between said shafts and including a fluid filled chamber disposed at the inner end of the housing, a piston rod adjustably connected to said cross member and extending parallel to said shafts, and a piston carried by said piston rod and slidable in said fluid-filled chamber between corresponding "door open" and "door closed" positions for providing resistance to movement of the tension member inwardly of the housing so as to control the rate of movement of the tension member inwardly of the housing under the force of said spring means, the piston moving outwardly of said chamber as the tension member is moved from its inner or "door closed" position towards its outer or "door open" position relative to the housing in response to door opening movement;

(e) fluid by-pass means for relieving said resistance over a final portion of the range of movement of the tension member into its "door closed" position in order to allow the force exerted by said spring means to accelerate the door to overcome any additional resistance afforded by a latch or catch on the door; and (f) means operable when the door closer is installed for adjusting the piston rod relative to the cross member of the cross head to adjust the relative position of the piston in said chamber so as to enable the operation of said fluid by-pass means to be adjusted.

13. A door closer comprising:

(a) a housing for fitting into a door and an anchor plate for fixing to a door frame adjacent to said door;

(b) a tension member extending longitudinally within the housing, coupled at its outer end to said anchor plate, and comprising two spaced parallel shafts with abutments at the inner ends thereof and a cross head slidably coupled to the shafts so as to afford a lost motion connection;

(c) spring means in said housing and acting on said cross head to engage the latter with said abutments and thereby urge said shafts from an outer or "door open" position in a direction inwardly of the housing towards an inner or "door closed" position and thereby to draw the housing and the anchor plate together so as to close the door to which the closer is fitted;

(d) uni-directionally operative fluid damping means disposed between said shafts and including a fluid filled chamber disposed at the outer end of the housing, a piston rod fixedly connected to said cross head and extending parallel to said shafts, and a piston carried by said piston rod and slidable in said fluid-filled chamber between corresponding "door open" and "door closed" positions for providing resistance to movement of the tension member inwardly of the housing so as to control the rate of movement of the tension member inwardly of the housing under the force of said spring means;

(e) fluid by-pass means for relieving said resistance over a final portion of the range of movement of the tension member into its "door closed" position in order to allow the force exerted by said spring means to accelerate the door to overcome any additional resistance afforded by a latch or catch on the door; and (f) adjustment means operable when the door closer is installed to adjust the relative position of the piston in said chamber so as to enable the operation of said fluid by-pass means to be adjusted.

14. A door closer according to claim 13 wherein said tension member includes an outer end portion which comprises an articulated chain coupled to said anchor plate, and additional spring means are provided which engage said abutments and maintain tension in the articulated chain independently of the first said spring means.

15. A door closer comprising:

(a) a housing for fitting into a door and an anchor plate for fixing to a door frame adjacent to said door;

(b) a tension member extending longitudinally within the housing and having an outer end portion thereof in the form of an articulated chain which is coupled to said anchor plate;

(c) main spring means in said housing and acting on said tension member to urge the latter from an outer or "door open" position in a direction inwardly of the housing towards an inner or "door closed" position and thereby to draw the housing and the anchor plate together so as to close the door to which the closer is fitted;

(d) uni-directionally operative fluid damping means including a piston slidable in a fluid-filled chamber between corresponding "door open" and "door closed" positions and coupled to said tension member for providing resistance to movement of the tension member inwardly of the housing so as to control the rate of movement of the tension member inwardly of the housing under the force of said spring means;

(e) a lost motion means whereby the piston is coupled to said tension member for enabling the tension member to be moved inwardly of the housing in the door closing direction in response to an external force at a rate faster than that determined by said main spring means under the control of the damping means;

(f) additional spring means for maintaining tension in said articulated chain independently of said main spring means;

(g) fluid by-pass means for relieving said resistance over a final portion of the range of movement of the tension member into its "door closed" position in order to allow the force exerted by said spring means to accelerate the door to overcome any additional resistance afforded by a latch or catch on the door; and (h) adjustment means operable when the door closer is installed to adjust the relative position of the piston in said chamber so as to enable the operation of said fluid by-pass means to be adjusted.

* * * * *